United States Patent [19]

Arendt et al.

[11] 4,132,317

[45] Jan. 2, 1979

[54] PIPE LAYING CRANE

[75] Inventors: Georgy A. Arendt; Vladimir V. Pokrovsky; Boris A. Burov; Alexandr L. Lipovich, all of Moscow; Evgeny I. Romanov, Zheleznodorozhny; Galina L. Vainshtein, Moscow; Tsalel S. Khaitovich, Balashikha, all of U.S.S.R.

[73] Assignee: Spetsialnoe Konstruktorskoe Bjuro Gazstroimashina, Moscow, U.S.S.R.

[21] Appl. No.: 786,836

[22] Filed: Apr. 12, 1977

[51] Int. Cl.[2] ..... B66C 23/72

[52] U.S. Cl. ..... 212/49; 180/9.48; 214/1 P

[58] Field of Search ..... 214/48, 49, 59 R, 8 R, 214/8 B, 1 P, 674, 670, 142, 75 H; 180/9.48, 79.2 R

[56] References Cited

U.S. PATENT DOCUMENTS

| | | | |
|---|---|---|---|
| 2,681,231 | 6/1954 | Kandrocki | 180/9.48 |
| 3,565,273 | 2/1971 | Hahn | 214/674 |
| 3,856,149 | 12/1974 | Shaw | 212/59 R |
| 3,945,518 | 3/1976 | Inoue | 214/142 |

*Primary Examiner*—Lawrence J. Oresky
*Attorney, Agent, or Firm*—Fleit & Jacobson

[57] ABSTRACT

This invention relates to load-lifting machinery and can find utility when applied to pipe laying cranes made use of in constructing large-diameter pipings. The pipe laying crane of the invention comprises the undercarriage carrying the framework with the engine and transmission, and mounted equipment. The mounted equipment incorporates the loading boom with a pipe hanger, the counterweight and the hoist which is connected to the loading boom and to the pipe hanger through a system of tackles. The undercarriage is made sectionalized i.e., it is composed of the two track bogies arranged on both sides of the framework, one of said bogies carrying the loading boom. The latter bogie is connected to the other bogie with a possibility of setting motion in the direction square with the frame axis for changing the track gauge of the undercarriage. Besides, the output unit of the transmission that imparts torque to the boom-carrying bogie, is made extensible. Such a pipe laying crane, while in working position (i.e., with the boom-carrying bogie extended), has a greater load-lifting capacity than the prior-art cranes of the same weight, whereas when in the position with the minimized track gauge between the bogies, the crane is transportable by rail or on trailers with its undercarriage in the assembled state.

7 Claims, 7 Drawing Figures

PIPE LAYING CRANE

This invention relates to load-lifting machinery provided with a side boom adapted for lifting, hauling and lowering loads on either side of the longitudinal axis thereof, and has particular reference to pipe laying cranes designed for handling and laying pipe strings into trenches when constructing pipelines.

The present invention can find most utility when applied to pipe laying cranes having a rather great load-lifting capacity made use of for constructing trunk pipings from large-diameter pipes (1420 mm and over).

It is known to be in extensive use pipe laying cranes, wherein the running gear or undercarriage mounts the framework that carries the engine and transmission adapted to translate torque therefrom to the undercarriage; the latter carries also the mounted equipment which incorporates the loading boom with a hanger for gripping the pipe being handled, and a counterweight, both of them being cantilever-mounted on both sides of the framework longitudinal axis, and has a hoist interlinked, through a system of tackles, to the loading boom and to the pipe gripping hanger.

The principal component of such a pipe laying crane is a tractor, predominantly a track-laying one.

The heretofore known pipe laying cranes based on conventional-design crawler tractors, are successfully applicable for constructing the pipings of dia. 1220-mm pipes (inclusive).

To handle pipes of larger diameters (1420 mm and over) now in current use for constructing trunk pipelines, a substantially higher load-lifting capacity is required on the part of the prior-art pipe laying cranes.

A number of engineering solutions of the problem has been developed up till now.

In particular, it is on a wide-scale use an increase of the mass of counterweights (both fixed in position or of the swing-aside type); however, such a trend in solving the problem results in a considerable rise of the mass of the whole pipe laying crane, as in some cases the mass of the tractor itself need also be increased so as to retain the own stability of the pipe laying crane with the counterweight swung aside and zero load on the pipe hanger.

One more way of increasing the loading capacity of the known pipe laying cranes is attaining a higher stability moment due to an increased distance from their centre of gravity to the edge of overturning.

Thus, there is known from patent literature the pipe laying crane, wherein the frame with the engine and transmission is arranged unsymmetrically relative to the longitudinal axis of the tractor undercarriage, being offset to the side opposite to the loading boom arrangement, i.e., so that the centre of gravity of the unloaded pipe laying crane towards the counterweight. Such a constructional arrangement made it possible to add much to the stability moment of the pipe laying crane and, consequently, to itsload-lifting capacity without increasing the mass of the crane.

However, further effective increasing of the stability moment is attainable in the known pipe laying cranes by increasing their track gauge in excess of 2.5 to 2.6 m, with the result that their outline dimensions, when in transit position, fail to comply with railway cargo clearance gauge. That is why such pipe laying cranes cannot be conveyed by rail without dismantling their undercarriage which is a labour consuming task.

On the other hand, transporting such pipe laying cranes under their own power or on trailers offers likewise much troubles on account of too great a track gauge of the undercarriage thereof.

It is therefore a primary object of the present invention to provide a pipe laying crane which would have a minimized weight and higher load-lifting capacity to be suitable for use in constructing large-diameter pipings (1420 mm and over).

It is another object of the present invention to provide a pipe laying crane which would be transportable by rail without dismantling the undercarriage thereof so as to render its handling less labour consuming.

Said and other objects are accomplished in a pipe laying crane having its undercarriage carrying the frame which mounts an engine and a transmission adapted to translate torque therefrom to the track bogie, and mounted equipment incorporating a loading boom with a hanger to catch the pipe being handled, and a counterweight, both said boom and said counterweight being cantilever-mounted on both sides of the frame longitudinal axis, said mounted equipment comprising a hoist linked to the loading boom and to the pipe hanger through a system of tackles; according to the present invention, said pipe laying crane features its undercarriage made sectionalized, i.e., composed of the two track bogies arranged on both sides of the frame longitudinal axis, one of said track bogies carries the loading boom alone and is linked to the other track bogie with a possibility of performing some setting movements with respect thereto in the direction normal to the longitudinal axis in order to change the track gauge of the undercarriage, whereas the output unit of the transmission that translates torque to the track bogie carrying the loading boom, is made extensible.

Such a constructional arrangement makes it possible to bring the pipe laying crane from transport position into working one by dislodging the boom-carrying track bogie towards the side opposite to the other track bogie. Besides, the track gauge of the crane undercarriage can be maximized, and the centre of gravity of the pipe laying crane (when unloaded) is displaced in this case towards the counterweight, whereby the stability moment of the pipe laying crane and, consequently, its load-lifting capacity are increased.

When displacing the boom-carrying track bogie towards the other track bogie, i.e., when bringing both bogies together, the pipe laying crane is rendered into transport position, wherein the track gauge of its undercarriage is minimized so that its outlinedimensions in that position well agree with the railway cargo clearance gauge; thereby, the pipe laying crane is made transportable by rail without dismantling the undercarriage thereof and, besides, the conditions of its transporting under own power or on trailers are also improved.

It is expedient that the track bogies should be interlinked by means of a hydraulic cylinder whose longitudinal axis be substantially perpendicular to the frame longitudinal axis, and by two telescopically extensible beams arranged parallel to said hydraulic cylinder on both sides thereof; and that the rod of the hydraulic cylinder be articulated to the frame of the boom-carrying track bogie, while the extensible members of the telescopic beams be fixed in place on said frame and the barrel of the hydraulic cylinder be articulated to the frame of the track bogie, while the guides of the telescopic beams are held in position to said frame.

Such a constructional arrangement enables one to travel the boom-carrying track bogie smoothly and without cocking with respect to the other track bogie carrying the rest of the equipment, in the direction normal to the frame axis.

The track gauge of the crane undercarriage can be adjusted, whenever necessary, in the course of the crane operation or on the move.

The axes of the telescopic beams are reasonable to lie substantially in the same plane, and the loose ends of the guides of said beams are expedient to be rigidly interlinked through a longitudinal girder so as to establish along therewith a bearing frame that carries the framework of the crane; an open-end hole should be provided in the longitudinal girder for the hydraulic cylinder rod to pass through.

Such a constructional feature provides for a necessary rigidity of the mutual arrangement of the telescopic beams and, thereby, a more precise travelling of the track bogie carrying the loading boom, as well as enables the hydraulic cylinder to be located at a height large enough to provide a required ground clearance.

The loading boom and the counterweight with the hoist may be mounted on the respective track bogies by way of U-frames, each of said frames embracing the track bogie from above and being held in place with its ends to the track bogie frame.

The U-frames are favourable to be interlinked through an extensible gantry established by two uprights whose bottom ends are articulated to the respective U-frames, while their top ends are interconnected through a hinge joint, the pivot shaft of said hinge joint mounting the sheaves of the tackle that interconnects the hoist with the loading boom.

Such a constructional arrangement ensures distribution of the load from said tackle between the both of the U-frames of the mounted equipment.

According to a further embodiment of the invention, used as the output unit of the transmission is a splined driven shaft mounted in the housing of the respective final drive reduction unit square with the frame longitudinal axis and carrying the casing of the clutch of said final drive reduction unit. The end of said splined shaft facing said track bogie, is locked against axial displacement with respect thereto, while its loose end is located in a guide which is made as a hollow shaft or axle and is mounted in the final drive reducer housing coaxially with said spined shaft, with a possibility of axial movements relative to said guide in the course of setting movements performed by said track bogie.

Provision of the driven shaft extensible along the final drive guide makes it possible to transmit torque from the engine to the boom-carrying track bogie with the latter in any position relative to the other track bogie, thus making possible a stepless adjustment of the track gauge of the crane undercarriage.

It is likewise advantageous that the free end of the splined shaft should be mounted on the guide through a spherical pivot provided on said shaft.

Such an arrangement rules out any possibility of cocking or interfering of the splined shaft with the guide.

In what follows the present invention is illustrated in a disclosure of one of possible embodiments thereof to be read in conjunction with the accompanying drawings, wherein.

The present invention is applicable to any of the heretofore known pipe laying cranes and is by no means bound to a specific embodiment thereof that will be the subject of the description that follows.

Discussed and presented in Figures here and hereinafter as an illustrative example of the present invention is a pipe laying crane based on a standard crawler-mounted tractor with a side loading boom which has been modified according to the present invention.

As pipe laying cranes are a widespread and common knowledge for those skilled in trade, there is no need to describe their units in detail save those directly involved in the present invention or modified according thereto.

Figure 1:
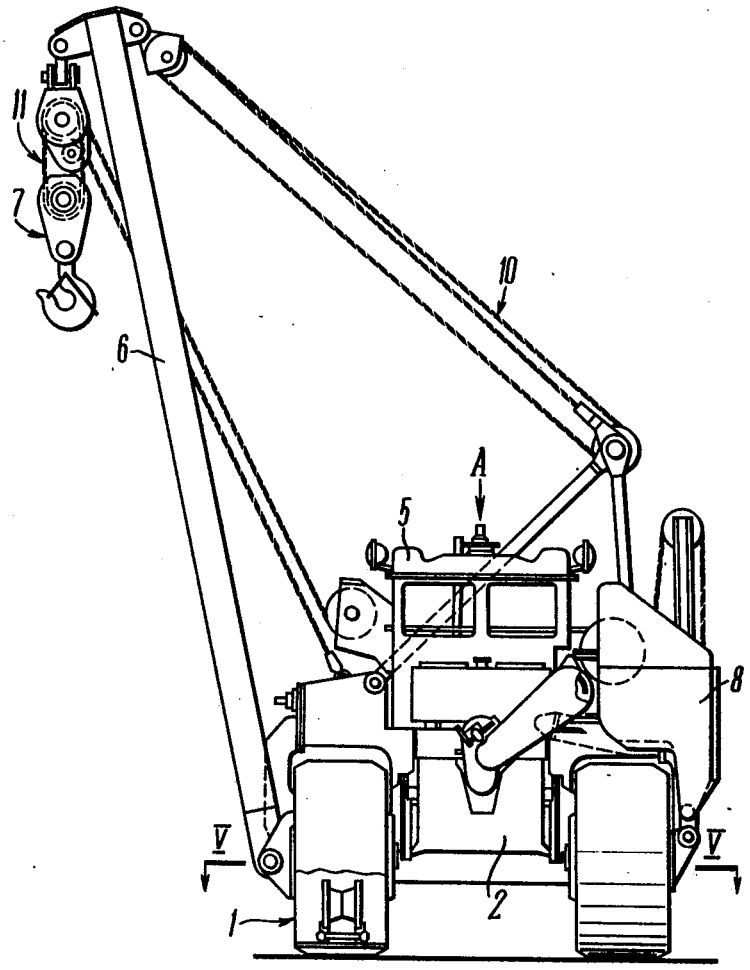
FIG. 1 is a diagrammatic view of a pipe laying crane, according to the invention, while in transit position (i.e., with the undercarriage track gauge minimized)
Figure 2:
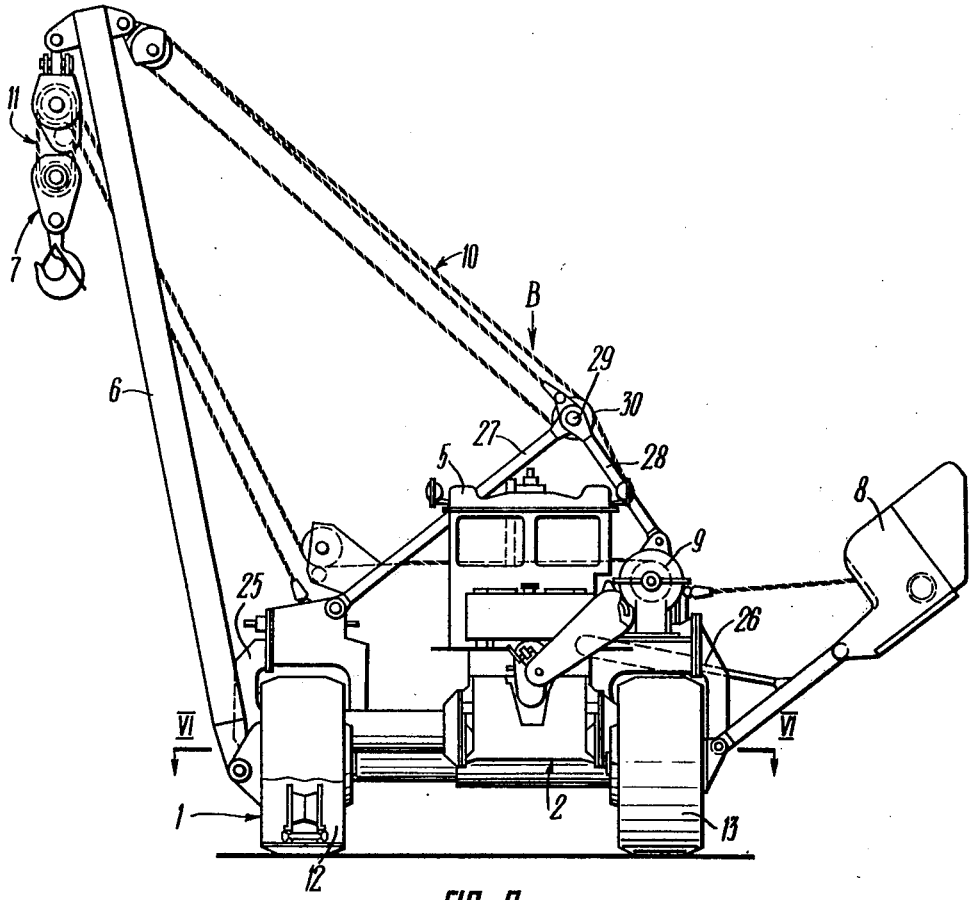
FIG. 2 illustrates the pipe laying crane of FIG. 1 while in working position (i.e., with the undercarriage track gauge maximized)

Reference being now directed to the accompanying drawings, FIGS. 1 and 2 show the pipe laying crane to comprise, according to the present invention a crawler-type undercarriage 1 which carries a framework (or body) 2, wherein an engine 3 (FIGS. 3 and 4) with a transmission 4 is accommodated, the latter imparting torque from the former to the undercarriage 1.

The framework 2 mounts an operator's cab 5 equipped with standard controls (not shown) of the motion of the pipe laying crane and of operation of the mounted equipment.

Figure 3:
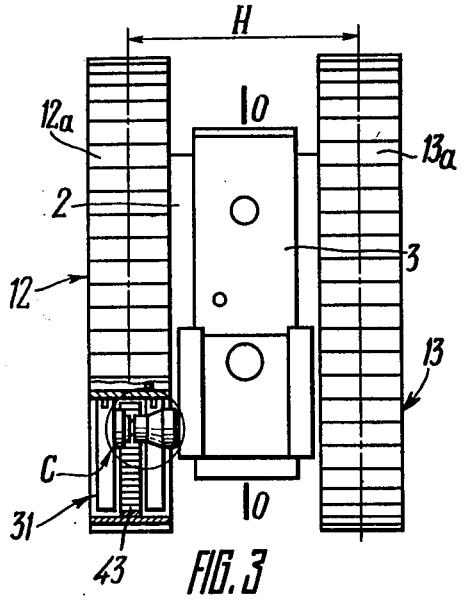
FIG. 3 is a view facing the arrow "A" in FIG. 1 with a fragmentarily cutaway view of the crawler chain of the boom-carrying track bogie (mounted equipment being purposely not shown)
Figure 4:
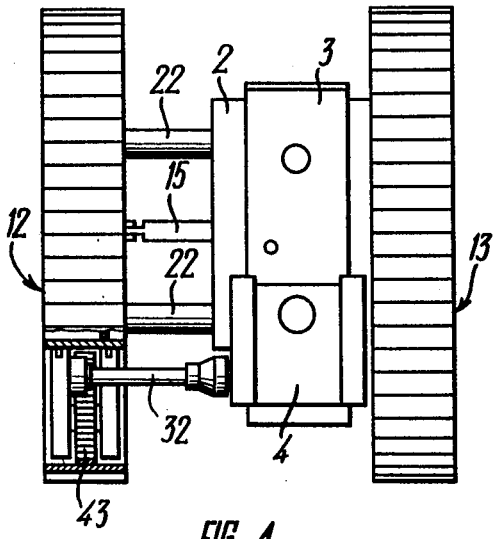
FIG. 4 is a view facing the arrow "B" in FIG. 2 showing the crawler chain of the boom-carrying track bogie in a fragmentarily cutaway view (mounted equipment being purposely not shown)

The mounted equipment (which is likewise standard, conventionally adopted for pipe laying cranes) comprises a loading boom 6 (FIGS. 1 and 2) with a hanger 7 for gripping the pipe being handled (not shown) and a counterweight 8, both being cantilever-mounted on both sides of the longitudinal axis "O-O" (FIG. 3 of the framework 2, as well as a hoist 9 linked through a system of tackles 10 and 11, to the loading boom 6 and to the pipe gripping hanger 7, respectively.

According to the invention, the undercarriage 1 is made section alized, viz.. of two track bogies 12 and 13 (FIGS. 2 to 6), arranged on both sides of the longitudinal axis "O-O" of the framework 2. The track bogie 12 mounts the loading boom, while the other track bogie 13 carries the framework 2, the counterweight 8 and the hoist 9.

The track bogie 12 carrying the loading boom 6, is linked to the other track bogie 13 so as to be free to perform setting movements with respect thereto in the lateral direction the axis "O-O" of the framework 2 in order to change the track gauge "H" (FIG. 3) (i.e., the distance between the longitudinal axes of the caterpillars) of the undercarriage 1 of the pipe laying crane.

To effect such a movement of the bogie 12 the latter is linked to the other bogie 13 through a hydraulic cylinder 14 (FIGS. 5 and 6) whose longitudinal axis is substantially perpendicular to the axis "O-O" of the framework 2, whilst a rod 15 (FIG. 6) of said hydraulic cylinder 14 is hinge-mounted through a lug 16 to a frame 17 of the track bogie 12 on which the loading boom 6 is mounted; a barrel 18 of said hydraulic cylinder 14 is hinge-mounted on a frame 19 of the other track bogie 13.

Two telescopically extensible beams 20 (FIG. 5) are mounted on both sides of the hydraulic cylinder 14 parallel to the axis thereof, each of said beams consisting of a guide 21 (FIG. 6) and an extensible member 22 mounted in said guide. The extensible members 22 of the both beams 20 are held in place to the frame 17 of the track bogie 12 carrying the loading boom 6, while the guides 21 are linked-in with the frame 19 of the other track bogie 13.

The axes of the telescopically extensible beams 20 lie substantially in the same horizontal plane, while the loose ends of the guides 21 of said beams 20 are rigidly interlinked through a longitudinal girder 23 so as to establish along therewith a bearing frame that carries the crane framework 2. For the rod 15 of the hydraulic cylinder 14 to freely pass through, a corresponding open-end hole 24 is provided in the longitudinal girder 23.

The loading boom 6 and the counterweight 8 with the hoist 9 are mounted on the respective track bogies 12 and 13 by way of U-frames 25 (FIG. 2) and 26, respectively, each of said U-frames is free to embrace the caterpillar of the respective track bogie 12 and 13 from above and with its ends is locked in place to the respective frames 17 and 19 of said bogies.

The aforesaid U-frames 25 and 26, according to the invention are interlinked through an extensible gantry which is formed by two uprights 27 and 28 (FIG. 2) whose bottom ends are articulated to the respective U-frames 25 and 26, while the top ends are interconnected via a hinge joint 29, the pivot shaft of said hinge joint carrying sheaves 30 of the tackle 10 that interconnects the hoist 9 with the loading boom 6.

The transmission 4 (FIG. 3) which imparts torque from the engine 3 to the caterpillars 12*a* and 13*a* of the respective track bogies 12 and 13, comprises all units conventional for crawler tractors, such as gearboxes, central (or main) drive (all being not shown), as well as final reducers and drives of each crawler track bogies 12 and 13.

According to the invention, the unit of the transmission 4 that translates torque from the final drive reduction unit to the transversally traversable track bogie 12 carrying the loading boom 6, is made extensible.

Every particular feature of said transmission output unit and of the parts and components of the adjacent units closely cooperating therewith that have been modified according to the present invention, will hereinafter be described in detail; while any of the operative units broadly known and commonly applied in the field may be used as the rest of the components of the transmission 4.

Figure 7:
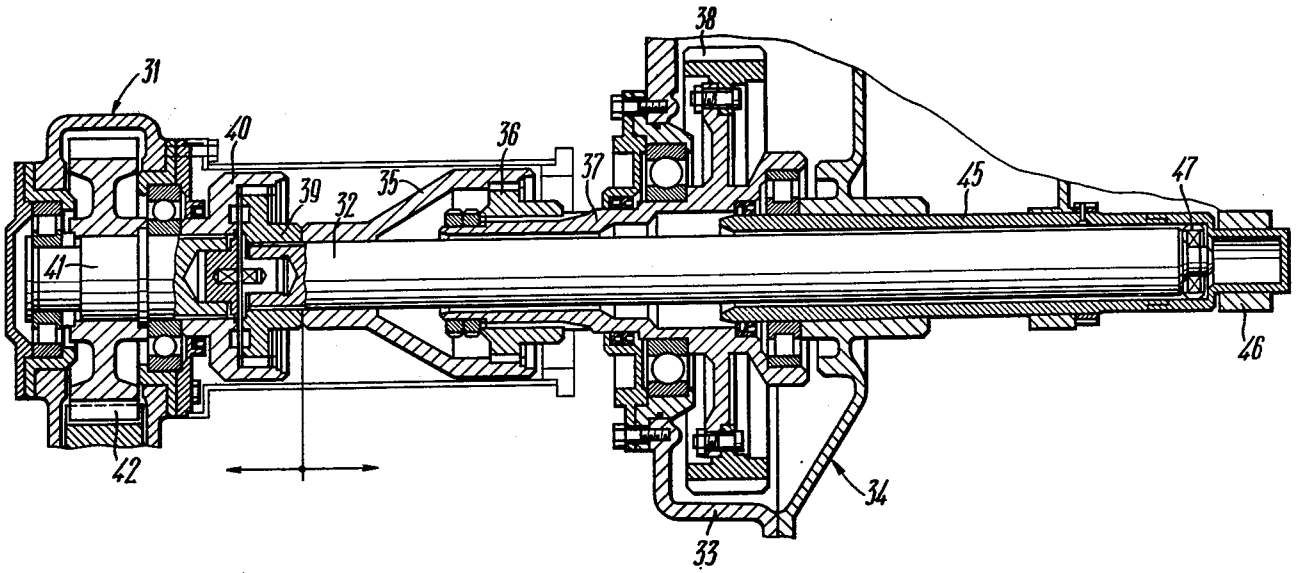
FIG. 7 is a scaled-up view of the area "C" in FIG. 3 taken substantially in longitudinal section, taken along the axis of the splined shaft of the transmission final drive reduction unit.

According to the invention, used as the output unit of the transmission 4 (FIGS. 3 and 4) adapted to transmit torque to a final drive 31 (FIG. 3) of the track bogie 12, is a driven splined shaft 32 (FIG. 7) mounted in a housing 33 of a respective final drive reduction unit 34 of the transmission 4 in the lateral direction the longitudinal axis "O-O" of the framework 2.

Said splined shaft 32 carries a toothed casing 35 adapted to interact by meshing with a toothed sleeve 36 of the clutch of the final drive reduction unit 34.

Said toothed sleeve 36 is set on the extension of a hub 37 protruding from the housing 33, while the opposite extension of said hub carries a drive gear 38 of the final drive reduction unit 34 that transmits rotation to the shaft 32 whatever the position of the latter with respect to the hub 37.

The end of the splined shaft facing the track bogie 12, is fixed against axial displacement with reference thereto.

To this aim, a toothed sleeve 39 of the clutch of the final drive 31 is set in place on said extension of the shaft 32, and a toothed casing 40 of that clutch is secured on a shaft 41 of a drive pinion 42 of the final drive 31.

Said drive pinion 42 imparts rotation through a train of idle gears (not shown) of the final drive 31 to a drive sprocket 43 on which the continuous caterpillar 12*a* (FIG. 3), while on the opposite said caterpillar 12*a* encompasses an idler wheel 44 serving to adjust the tension of said caterpillar.

Provision is made for track support rollers (not shown) set on the frame 17 of the track bogie 12 between the drive sprocket 43 and the idler wheel 44, through which rollers the pipe laying crane rests upon the caterpillar 12*a*. The other bogie 13 with the caterpillar 13*a* is arranged in a similar way.

According to the invention, the splined shaft 32 is made extensible in the course of setting motion performed by the track bogie 12. To this end, the loose end of the shaft 32 is mounted in a stationary fixed guide 45 coaxial therewith so as to be free to perform axial movements with respect to said guide. Said guide 45 is made as a hollow axle which with its one end is set in an open-end hole coaxial with the shaft 32 and made in the housing 33 of the final drive reduction unit 34 on the side opposite to the final drive 31, while the other end of said hollow axle is mounted on a bracket 46 made fast on the crane framework 2.

The guide 45 should be long enough for the splined shaft 32 to accommodate with the track gauge "H" of the pipe laying crane undercarriage 1 minimized.

In order that the splined shaft 32 be free to slide along the guide 45 without oblique setting or scoring its inner surface, the loose end of said shaft 32 carries a spherical pivot 47 slidible along the guide 45.

The pipe laying crane of the present invention operates as follows.

Figure 5:
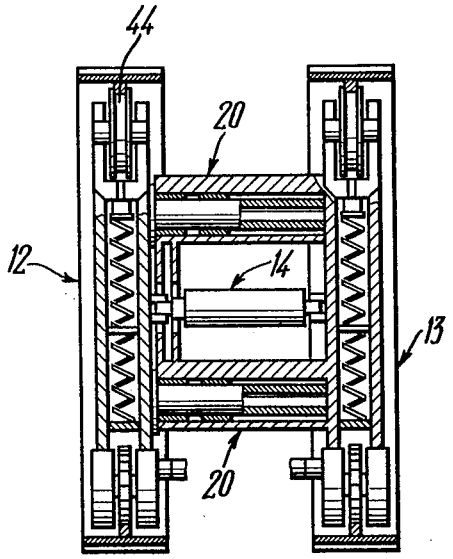
FIG. 5 is a section taken along the line V—V in FIG. 1.

When in the initial (transport) position illustrated in FIG. 1 the pipe laying crane features the minimized track gauge "H" of its undercarriage 1. In this case the rod 15 of the hydraulic cylinder 14, the extensible members 22 of the telescopic beams 20 and the splined shaft 32 are in the rightmost position, as shown in FIGS. 3 and 5.

With the pipe laying crane in that position the track gauge "H" of its undercarriage 1 ensures that the outline dimensions of the machine in transit position comply with the railway cargo clearance gauge, so that the crane may be conveyed by rail on trailers without dismantling the undercarriage thereof.

The pipe laying crane is propelled by a conventional way. Upon starting the engine 3 torque is imparted therefrom through the transmission 4 to the caterpillars 12a and 13a of the track bogies 12 and 13.

Torque is transmitted to the splined shaft 32 (FIG. 7) of the final drive reduction unit 34 from its drive gear 38 through its hub 37, the toothed sleeve 36 and the toothed casing 35 of one of the clutches, while from the shaft 32 torque is imparted through the toothed sleeve 39 and the toothed casing 40 of the other clutch to the shaft 41 of the drive pinion 42 of the final drive 31, which drive pinion translates torque further on through a train of idle gears (not shown) to the drive sprocket 43 which rotates the caterpillar 12a of the track bogie 12.

Torque transmission to the caterpillar 13a of the track bogie 13 differs from that to the caterpillar 12a of the track bogie 12 only in the construction of the splined shaft 32 which is made unextensible in the torque transmission pattern of the caterpillar 13a of the track bogie 13.

In order to bring the pipe laying crane from the transit (FIG. 1) to the working position (FIG. 2), one must displace the track bogie 12 carrying the loading boom 6, in a cross direction away from the other track bogie 13 so as to increase the track gauge "H" which is in fact the distance across the both bogies.

Figure 6:
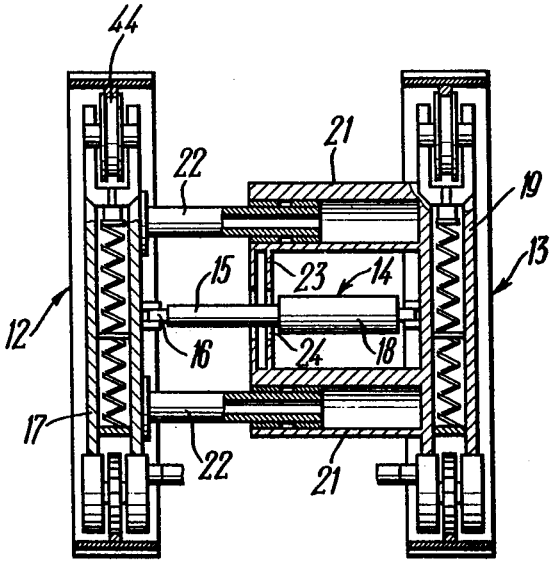
FIG. 6 is a section taken along the line VI—VI in FIG. 2.

The track bogie 12 is dislodged to the leftmost (as viewed in FIGS. 2, 4 and 6) position by the hydraulic cylinder 14 whose rod 15 is in this case extended from the cylinder barrel 18 so as to change its rightmost position (FIG. 5) for the leftmost one (FIG. 6). There travel along with the bogie 12 in the same direction also the extensible members 22 of the beams 20 that slide along their guides 21 for the purpose, as well as the splined shaft 32 of the final drive reduction unit 34 of the transmission 4 which shaft in this case is extended from the guide 45 while sliding thereover with its spherical pivot 47.

With the pipe laying crane in transit position (FIG. 1) the track bogies 12 and 13 are arranged symmetrically with respect to the longitudinal axis "O-O" of the framework 2, as shown in FIG. 3 and crane centre of gravity approximates the axis "O-O" when the boom 6 carries no load.

Displacement of the track bogie 12 carrying the loading boom 6, to the leftmost position (FIG. 2) with respect to the other track bogie 13 carrying all the rest of the crane units, apart from enlarging the track gauge "H" of the crane undercarriage (which on its own account adds to the stability moment of the crane), also renders the crane unsymmetric relative to the longitudinal axis "O-O" of the framework 2.

Owing to that fact the total weight of the pipe laying crane becomes redistributed with respect to the track bogies 12 and 13 so that its centre of gravity gets offset from the line "O-O" towards the counterweight 8. Thereby the stability moment of the pipe laying crane and, thence, its load capacity are heightened.

That is why the crane, while in working position (FIG. 2) is capable of hoisting a load weighing much more than that hoisted by the crane in transit position (FIG. 1).

To further increase load-lifting capacity of the crane one can swing aside the counterweight 8 about its bracket as shown in FIG. 2.

The operation of the mounted equipment of the pipe laying crane discussed above does not substantially differ from that of the commonly known cranes.

The pipe (not shown) lying on the ground or one from a pile is secured by a wire rope to the hook of the hanger 7 (FIG. 2). Then the pipe is lifted hauled and lowered into the trench by appropriately changing (by virtue of the hoist) the length of the wire ropes of the tackles 11 and 10 which control the hanger 7 and the loading boom, respectively. As a result, the centre of gravity of the pipe laying crane is offset towards the loading boom under the weight of the pipe being handled.

However, said displacement of the crane centre of gravity occurs within the limits of its overturning edge, as the crane features higher stability moment as compared to the conventional-design pipe laying cranes of the same weight.

To bring the pipe laying crane from working (FIG. 2) to transit position (FIG. 1) the afore-described procedure is to be reversed.

Thus, the pipe laying crane of the invention has greater load-lifting capacity when in working position than the known cranes of the same weight, whereas when in transit position, the proposed crane is transportable by rail or on trailers without dismantling its undercarriage which renders profitable its application for constructing modern large-diameter (1420 mm and over) pipelines, as well as enables such crane to be used very efficiently for handling operations in some other branches of construction engineering.

What we claim is:

1. A pipe laying crane, comprising: a framework carrying an engine and a transmission and having a longitudinal axis; an undercarriage mounting said framework and made sectionalized from two track bogies arranged on both sides of said framework, one of said two track bogies being connected to the other with a possibility of setting motion with respect thereto in a direction perpendicular to the longitudinal axis of said framework so as to change the track gauge of said undercarriage the other of said two track bogies being fixed relative to said framework; articulated links interconnecting said bogies; and mounted equipment, comprising: a loading boom cantilevermounted on said one of said two track bogies of said undercarriage and a hanger carried by said loading boom for gripping the pipe being handled, a counterweight cantilevermounted on the other of said two track bogies of said undercarriage, a hoist mounted on said other of said two track bogies, and a system of tackles interlinking said hoist, said articulated links, said loading boom and said hanger for controlling the angle of the boom at any relative position of said bogie; said transmission having an extensible output unit adapted to transfer torque to said one of said two track bogies of said undercarriage.

2. A pipe laying crane as claimed in claim 1, wherein the track bogies include frames and are interconnected through a hydraulic cylinder having a barrel and cylinder rod and whose axis is substantially perpendicular to the framework longitudinal axis, and through two telescopically extensible beams arranged on both sides of said hydraulic cylinder parallel thereto, said hydraulic cylinder having a rod articulated to the frame of said one of said two track bogies, said telescopically extensible beams having extensible members connected to said frame of said one of said two track bogies and guides for said extensible members having first ends connected to the frame of the other track bogie, the barrel of the hydraulic cylinder being articulated to the frame of the other track bogie.

3. A pipe laying crane as claimed in claim 2, further comprising a longitudinal girder, and wherein said telescopically extensible beams have axes lying substantially in the same horizontal plane, and wherein said guides have loose ends opposite said first ends, said loose ends being rigidly interlinked through the longitudinal girder to form along therewith a bearing frame on which the framework is mounted, said longitudinal girder being provided with an appropriate open-end hole for the hydraulic cylinder rod to pass through.

4. A pipe laying crane as claimed in claim 1, further comprising U-shaped frames and wherein the loading boom and the counterweight with the hoist are mounted on respective track bogies by way of said U-shaped frames, each of said U-shaped frames being free to embrace the respective track bogie from above and having its ends connected to the frame of the embraced respective track bogie.

5. A pipe laying crane as claimed in claim 4, further comprising an extensible gantry for interconnecting the U-shaped frames and established by two uprights, each of said uprights having a bottom end articulated to one of the U-frames, and a top end interconnected to the top end of the other upright; and a hinge joint having a pivot shaft for interconnecting said top ends, said tackle interlinking the hoist to the loading boom having sheaves carried by said pivot shaft.

6. A pipe laying crane as claimed in claim 1, wherein said extensible output unit comprises a driven splined shaft; and a final drive reduction unit having a housing for holding said splined shaft in a direction perpendicular to the framework longitudinal axis, a clutch having a casing carried by said splined shaft, said splined shaft having an end facing the track bogie carrying the loading boom locked against axial displacement with respect thereto, and a loose end, and a guide for said loose end mounted in the housing of the final drive reduction unit coaxially with said splined shaft, said splined shaft being axially movable with respect to said guide in the course of setting motion of said track bogie.

7. A pipe laying crane as claimed in claim 6, further comprising a spherical pivot provided on the loose end of the splined shaft for mounting the splined shaft in the guide.

* * * * *